US010932593B2

(12) United States Patent
Altizer

(10) Patent No.: US 10,932,593 B2
(45) Date of Patent: Mar. 2, 2021

(54) ORGANIZER SET WITH RETENTION SYSTEM AND METHOD OF MAKING SAME

(71) Applicant: Edsal Manufacturing Company, Inc., Chicago, IL (US)

(72) Inventor: John Altizer, Chicago, IL (US)

(73) Assignee: EDSAL MANUFACTURING COMPANY, INC., Chicago, IL (US)

( * ) Notice: Subject to any disclaimer, the term of this patent is extended or adjusted under 35 U.S.C. 154(b) by 60 days.

(21) Appl. No.: 16/428,245

(22) Filed: May 31, 2019

(65) Prior Publication Data

US 2020/0069082 A1 Mar. 5, 2020

Related U.S. Application Data

(60) Provisional application No. 62/724,668, filed on Aug. 30, 2018.

(51) Int. Cl.
*A47F 5/08* (2006.01)

(52) U.S. Cl.
CPC ..... *A47F 5/0815* (2013.01)

(58) Field of Classification Search
CPC ..... A47F 5/0815; A47F 5/0823; A47B 57/50; B25H 3/04
USPC ..... 248/220.31
See application file for complete search history.

(56) References Cited

U.S. PATENT DOCUMENTS 5,464,103 A * 11/1995 O'Brien ..... A47B 57/20 211/133.3
5,503,277 A * 4/1996 O'Brien ..... A47B 57/20 211/106.01
5,801,920 A * 9/1998 Lee ..... G06F 1/184 248/220.31
6,299,001 B1 * 10/2001 Frolov ..... A47F 5/01 211/106
6,945,414 B1 * 9/2005 Stevens ..... A47F 5/0846 211/183
7,441,736 B2 * 10/2008 Wiltfang ..... A47F 5/0823 211/87.01
8,899,424 B2 * 12/2014 Bayazit ..... H04Q 1/064 211/26
8,931,746 B2 * 1/2015 Fanning, Jr. ..... A47F 7/0007 248/220.31
9,180,591 B2 * 11/2015 McLean ..... B25H 3/04
10,051,978 B2 * 8/2018 Gupta ..... A47B 96/061
10,405,675 B1 * 9/2019 Yu ..... A47F 5/0823

(Continued)

*Primary Examiner* — Bradley Duckworth
(74) *Attorney, Agent, or Firm* — Wood Herron & Evans LLP

(57) ABSTRACT

A retention system is disclosed and includes a planar surface having first and second opposing sides. The planar surface has an array of spaced through holes defining a plurality of rows of through holes and a plurality of columns of through holes. The planar surface also has an array of spaced protrusions extending from the first side of the planar surface and defining a plurality of rows of protrusions and a plurality of columns of protrusions. Each row of protrusions is disposed between two adjacent rows of the through holes and each protrusion includes a through slot oriented in a column direction of the protrusion. An organizing set is further disclosed that includes the retention system and an attachment accessory configured to be selectively coupled to the planar surface of the retention system. A method of making the retention system is also disclosed.

28 Claims, 7 Drawing Sheets

(56) References Cited

U.S. PATENT DOCUMENTS

| | | | | |
|---|---|---|---|---|
| 10,492,631 | B2 * | 12/2019 | Velderman | A47F 5/0853 |
| 2004/0159755 | A1 * | 8/2004 | Valiulis | A47F 5/0823<br>248/220.43 |
| 2005/0045573 | A1 * | 3/2005 | Winig | F16B 12/26<br>211/90.02 |
| 2005/0072746 | A1 * | 4/2005 | O'Brien | A47F 5/0823<br>211/59.1 |
| 2007/0290107 | A1 * | 12/2007 | Lang | A47F 5/0815<br>248/220.31 |
| 2011/0073730 | A1 * | 3/2011 | Kitchen | A47F 5/0815<br>248/220.31 |
| 2014/0251933 | A1 * | 9/2014 | Old | A47B 57/06<br>211/90.04 |
| 2016/0286985 | A1 * | 10/2016 | Shamp | B25H 3/04 |
| 2019/0328134 | A1 * | 10/2019 | Walker | A47B 57/482 |

* cited by examiner

ORGANIZER SET WITH RETENTION SYSTEM AND METHOD OF MAKING SAME

CROSS-REFERENCE TO RELATED APPLICATION

This application claims the benefit of U.S. Provisional Patent Application Ser. No. 62/724,668, filed Aug. 30, 2018, the disclosure of which is incorporated by reference herein in its entirety.

FIELD OF THE INVENTION

This invention relates generally to the organization of items, and more particularly to retention boards for securing hooks and organizers.

BACKGROUND

Peg boards are commonly used to secure hooks or organizers such that hand tools and the like can be hung from the hooks and organizers. Typical peg boards have an array of equally spaced through holes that are generally ¼ inch in diameter and spaced apart vertically and horizontally on 1 inch centers. Hooks are typically designed to fit into and engage at least two of the holes so as to secure the hooks to the peg board. Peg boards are often made of some sort of fiberboard.

If a peg board is installed directly on a wall, it is difficult to insert the hooks into the holes because the wall hinders the hook from being inserted to the back side of the peg board. As such, the peg board must be mounted away from the wall by using spacers that will allow the hook to be inserted into the holes and to the back of the peg board. Having to use spacers increases the installation time.

SUMMARY

A retention system includes a planar surface having first and second opposing sides. An array of spaced through holes are formed in the planar surface and define a plurality of rows of through holes and a plurality of columns of through holes. An array of spaced protrusions extending from the first side of the planar surface are also formed and define a plurality of rows of protrusions and a plurality of columns of protrusions. Each row of protrusions is disposed between two adjacent rows of the through holes and each protrusion includes a through slot oriented in a column direction of the protrusion. In one embodiment, each column of through holes is parallel to a corresponding column of protrusions. In another embodiment, each column of through holes is collinear with a corresponding column of protrusions. In yet another aspect, the through slot of each protrusion may have an outer boundary defining a trapezoid. In an exemplary embodiment, the planar surface and the protrusions may be a monolithic structure.

In a further embodiment, an organizing set includes a retention system, such as the one described above, and further includes an attachment accessory having at least one tab, wherein the attachment accessory is configured to support an item, and wherein the attachment accessory is configured to be selectively coupled to the planar surface by engaging the at least one tab with at least one through slot in the protrusion. The retention board may have the same features and arrangement as the one described above. Embodiments of the invention include several different attachment accessories for use with the retention system.

In yet another embodiment, a method for manufacturing a retention system includes providing a planar surface having first and second opposing sides, forming in the planar surface an array of spaced through holes defining a plurality of rows of through holes and a plurality of columns of through holes, and forming in the planar surface an array of spaced protrusions extending from the first side of the planar surface and defining a plurality of rows of protrusions and a plurality of columns of protrusions. Each row of protrusions is disposed between two adjacent rows of the through holes and each protrusion includes a through slot oriented in a column direction of the protrusion. In one embodiment, forming the array of spaced through holes may be by drilling or punching. In another embodiment, each of the forming steps may be by stamping. In yet a further embodiment, the forming of the through holes and the forming of the protrusions occur simultaneously.

BRIEF DESCRIPTION OF THE DRAWINGS

The accompanying drawings, which are incorporated in and constitute a part of this specification, illustrate one or more exemplary embodiments of the invention and, together with the general description of the invention given above, and the detailed description of the embodiments given below, serve to explain the embodiments of the invention.

DETAILED DESCRIPTION

Figure 2:
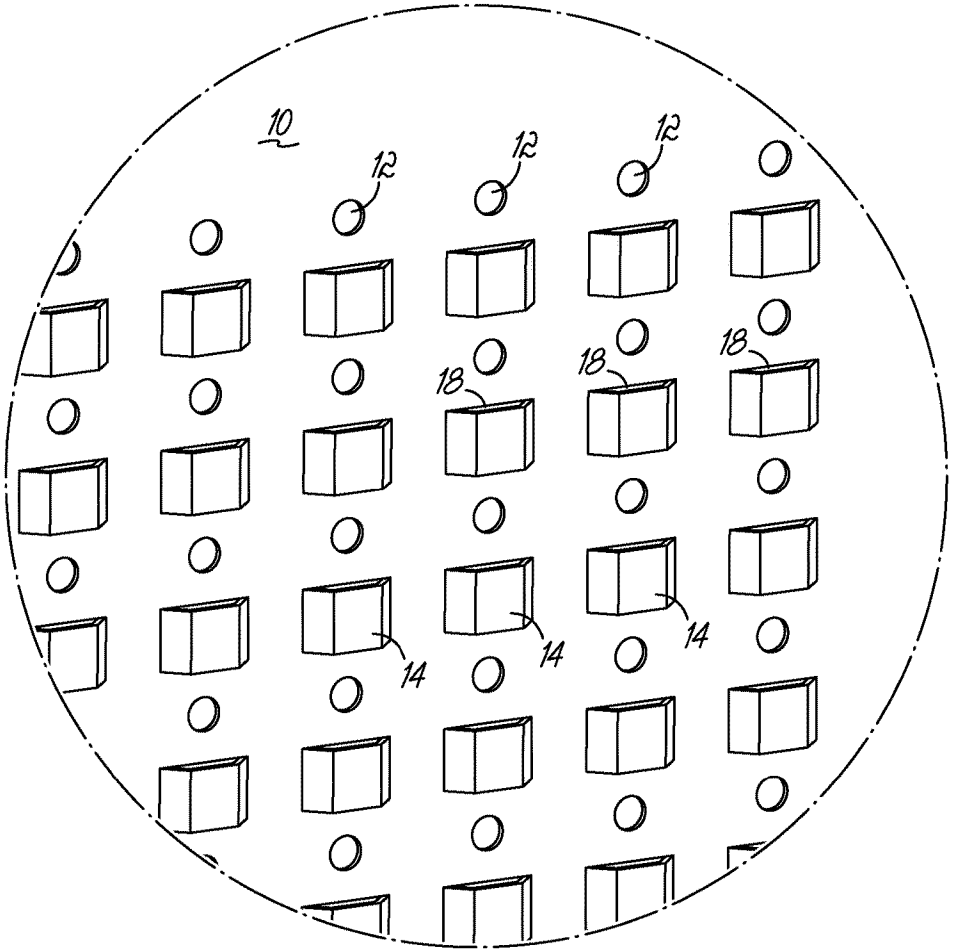
FIG. 2 is detail 2 of the retention board shown in FIG. 1.
Figure 1:
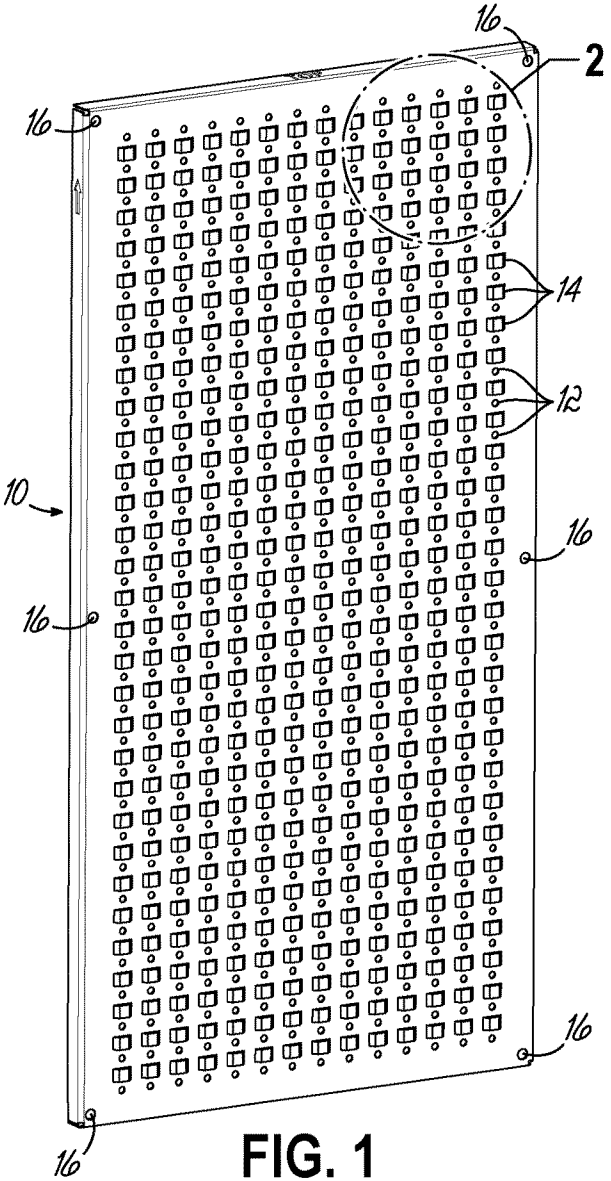
FIG. 1 is a perspective view of the retention board according to one embodiment of the invention.

A retention board 10 with a planar surface according to one embodiment of the invention is shown in FIG. 1. With reference to FIGS. 1 and 2, the retention board 10 includes an array of equally-spaced through holes 12 arranged in rows and columns. The though holes 12 can be spaced from each other vertically and horizontally at least one inch from their centers. Alternatively, the through holes 12 could be equally spaced apart several inches from their centers. In addition, the spacing vertically and horizontally does not have to be equal. The retention board 10 also includes an array of equally-spaced protrusions 14 arranged in rows and columns with each protrusion 14 being positioned between the through holes 12. The retention board 10 further includes a plurality of mounting holes 16 positioned around the periphery of the retention board 10. Screws, nails, and the like can be used in conjunction with the mounting holes 16 to secure the retention board 10 to a wall.

The retention board 10 is preferably made from a sheet of steel but could be made from a variety of other suitable structural materials. The through holes 12, protrusions 14, and mounting holes 16 are punched or stamped into the retention board 10 from the back to front. The through holes 12 may also be drilled. When the protrusions 14 are punched or stamped from back to front into the retention board 10, a through slot 18 (FIG. 2) is formed. In one embodiment, the planar surface of the retention board 10 and the protrusions 14 are a monolithic structure. In one embodiment, the punch may be shaped such that the through slot 18 has an outer boundary that defines a trapezoid. As illustrated in the FIG. 1, in an exemplary embodiment, the retention board 10 is rectangular with the long side intended to be mounted on a wall vertically so that the through slots 18 in the protrusions 14 are oriented vertically. In other words, the through slots 18 are aligned with the long side of the retention board 10. In an alternative embodiment, the retention board 10 could also be configured such that the long side is intended to be mounted horizontally on a wall. In that configuration the protrusions 14 would have to be rotated 90 degrees such that the through slots 18 align with the short side of the retention board 10. The shape and orientation of the retention board 10 may vary so along as the through holes 12 are generally horizontally and vertically aligned and the through slots 18 of protrusions 14 are generally vertical.

Figure 5:
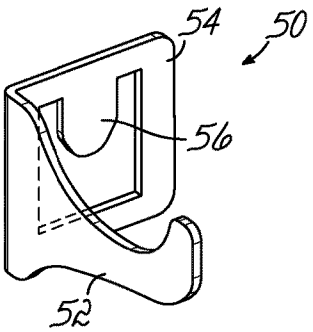
FIG. 5 is a roller holder for use with the retention board of FIG. 1.
Figure 4:
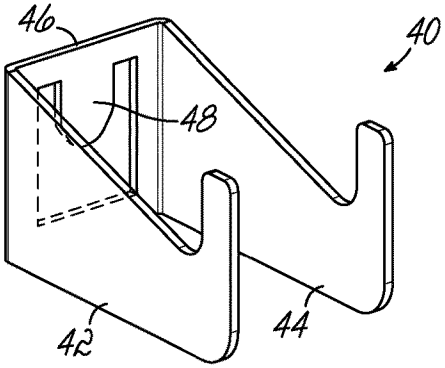
FIG. 4 is a double light hook for use with the retention board of FIG. 1.
Figure 3:
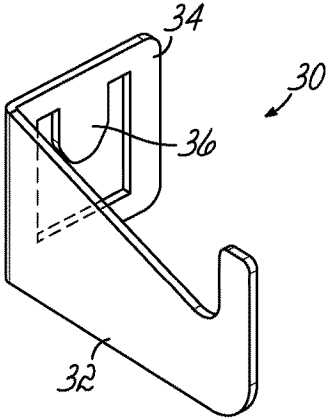
FIG. 3 is a single light hook for use with the retention board of FIG. 1.

FIGS. 3-14 illustrate a series of exemplary attachment accessories that are designed to be used in conjunction with the retention board 10. The exemplary attachment accessories include various hooks, a shelf, and an organizer. With specific reference to FIG. 3, a single light hook 30 is illustrated. The hook 30 includes an extension portion 32 and a mounting portion 34. The mounting portion 34 includes a tab 36 which is sized to fit into the through slot 18 of protrusion 14 to thereby removably secure the hook 30 to the retention board 10. The tab 36 is in a cutout in the mounting portion 34 so as to lie in the same plane as the mounting portion 34. As is illustrated in FIGS. 4-14, the other attachment accessories have tabs that are in the same plane as their respective mounting portions. FIG. 4 illustrates a double light hook 40 with two extension portions 42, 44 and a mounting portion 46 with a tab 48. Tab 48 is sized to fit into the through slot 18 of protrusion 14 to thereby removably secure the hook 40 to the retention board 10. FIG. 5 illustrates a roller holder 50 with an extension portion 52 and a mounting portion 54 with a tab 56. Tab 56 is sized to fit into the through slot 18 of protrusion 14 to thereby removably secure the roller holder 50 to the retention board 10.

Figure 6:
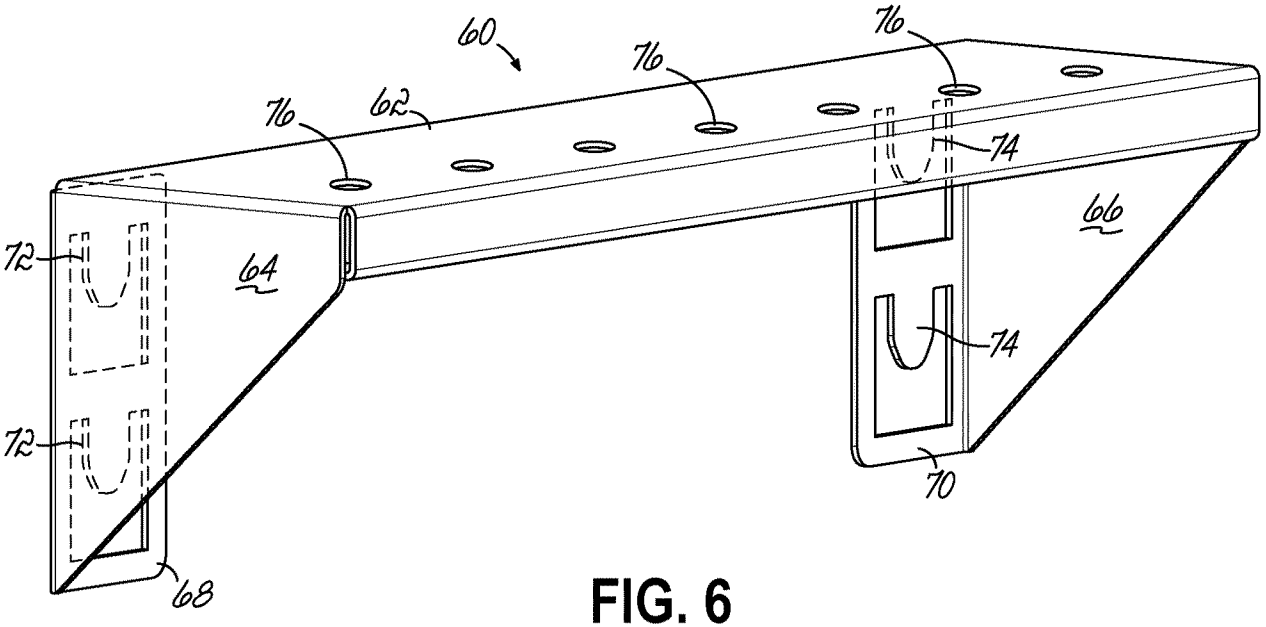
FIG. 6 is a shelf for use with the retention board of FIG. 1.

FIG. 6 illustrates a shelf unit 60 which has a support surface 62 connected at either end to angle members 64, 66. Each angle member 64, 66 has a mounting portion 68, 70, respectively. Each mounting portion 68, 70 has two tabs 72, 74, respectively. Each tab 72, 74 is sized and spaced apart such that the shelf unit 60 engages four through slots 18 of protrusions 14 to secure the shelf unit 60 to the retention board 10. The support surface 62 includes a series of holes 76.

Figure 7:
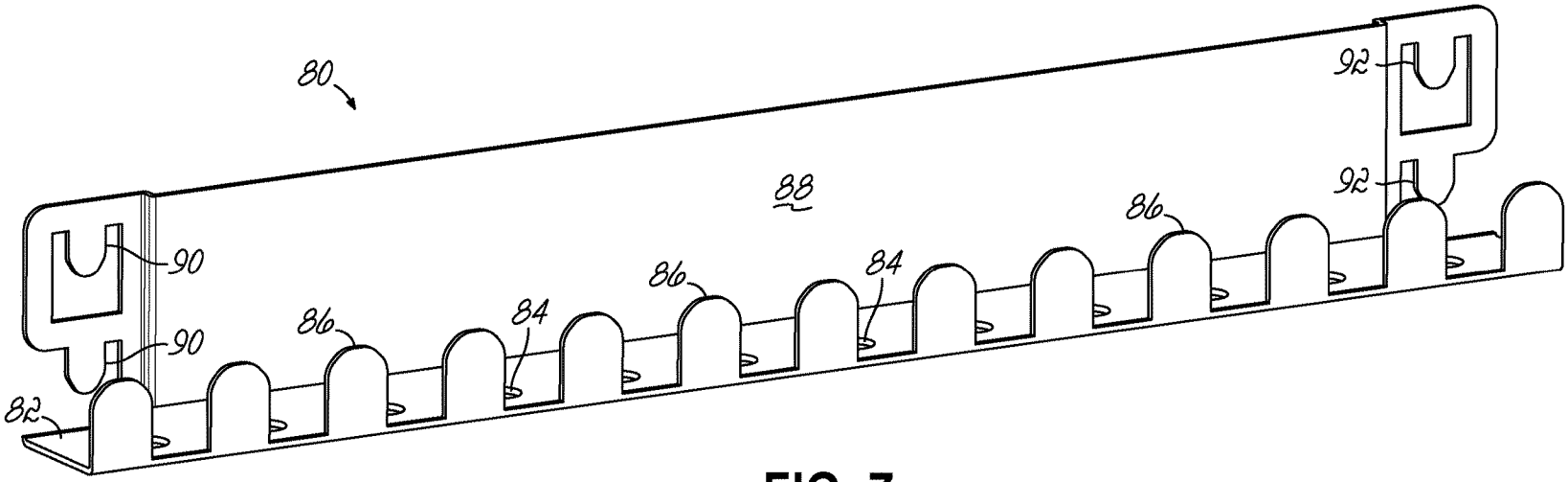
FIG. 7 is a hanging and screw driver organizer for use with the retention board of FIG. 1.
Figure 8:
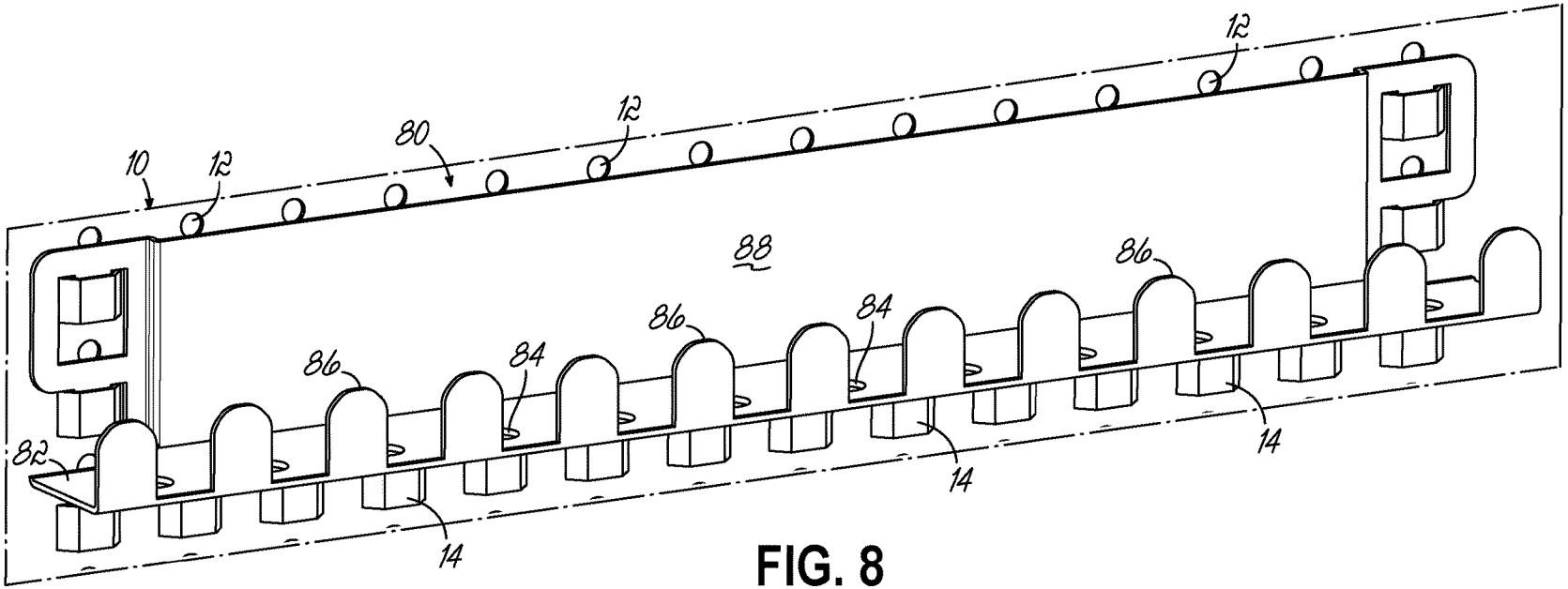
FIG. 8 is the hanging and screw driver organizer of FIG. 7 attached to the retention board of FIG. 1.
Figure 9:
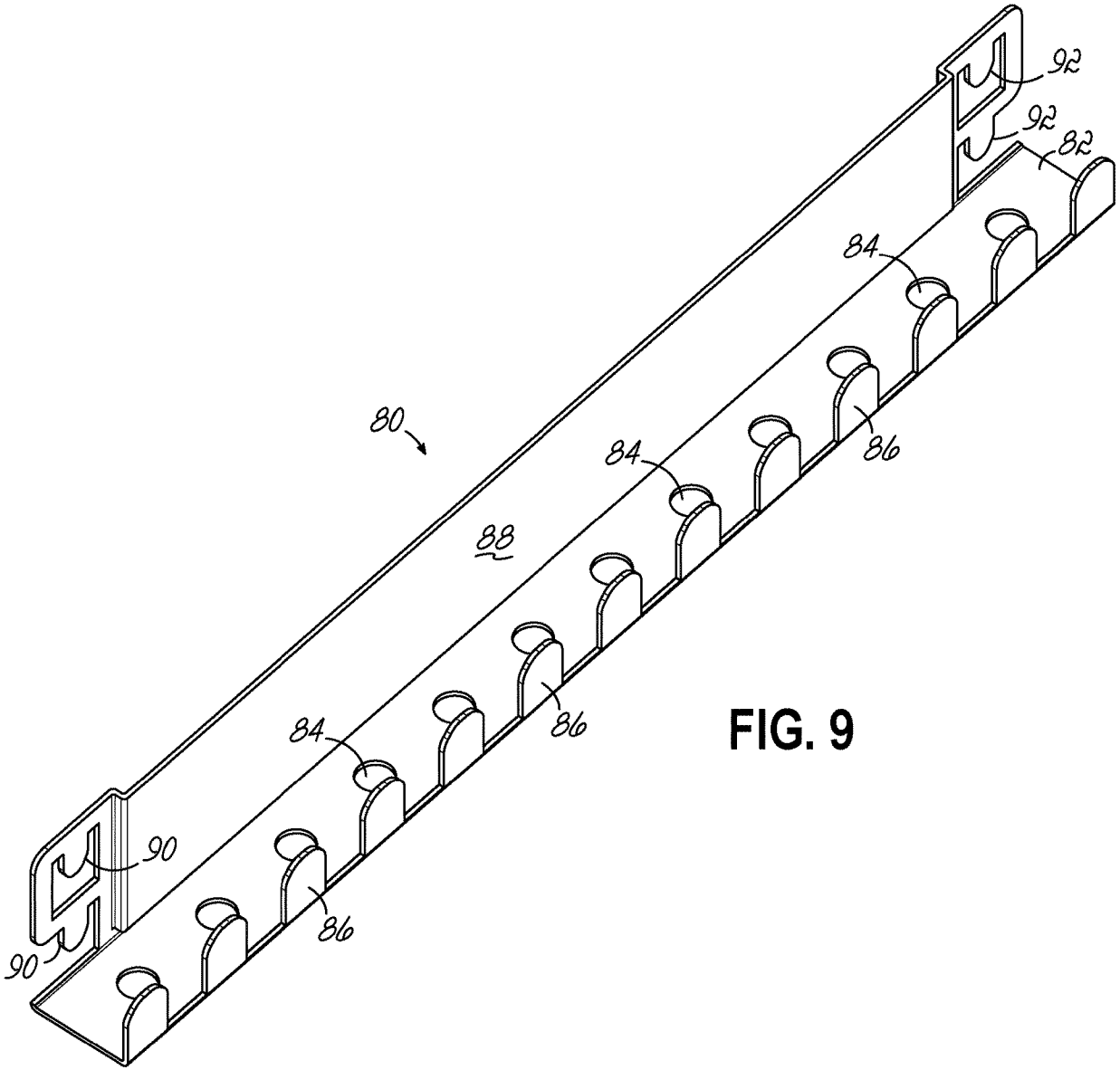
FIG. 9 is another view of the hanging and screw driver organizer of FIG. 7.

FIGS. 7 and 9 illustrates an organizer 80 which is configured to hang items from and act to hold screwdrivers or other tools, for example. The organizer 80 includes an extension portion 82 which includes a series of holes 84 and a series of spaced-apart, upwardly pointing fingers 86. The organizer 80 includes a mounting portion 88 spanning nearly the entire length of the extension portion 82. The mounting portion 88 includes two tabs 90, 92 on each of its ends. Each tab 90, 92 is sized and spaced apart such that the organizer 80 engages four protrusions 14 to secure the shelf unit 60 to the retention board 10 as illustrated in FIG. 8. Mounting portion 88 is shaped such that its ends having the tabs 90, 92 are spaced rearwardly, i.e., offset, so that the mounting portion 88 clears the protrusions 14 behind it when the organizer 80 is secured to the retention board 10.

Figure 11:
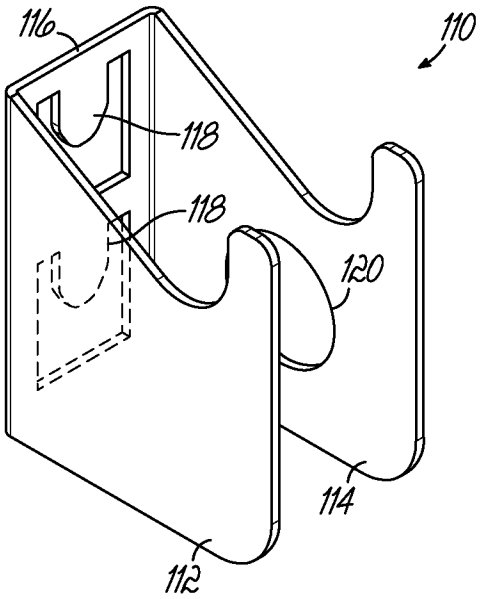
FIG. 11 is a double light hook for use with the retention board of FIG. 1.
Figure 10:
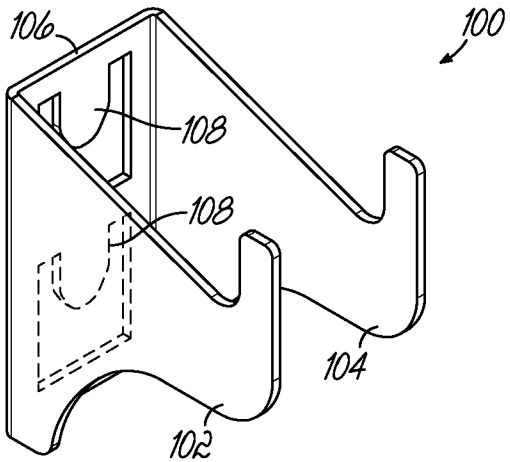
FIG. 10 is a double light hook for use with the retention board of FIG. 1.
Figure 13:
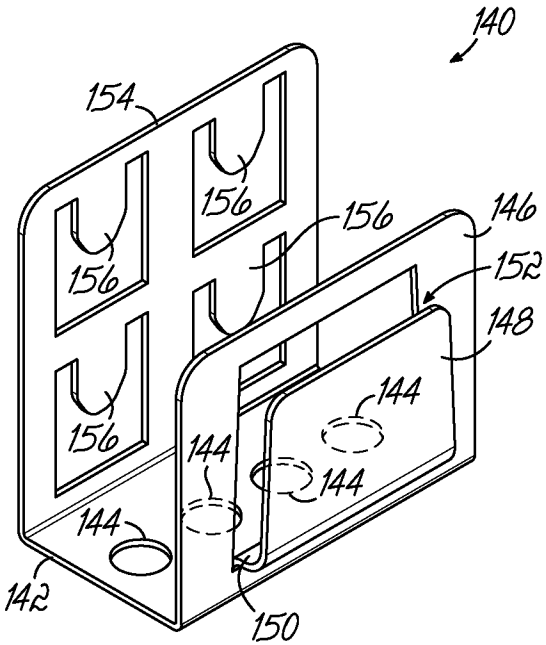
FIG. 13 is an organizer for use with the retention board of FIG. 1.
Figure 12:
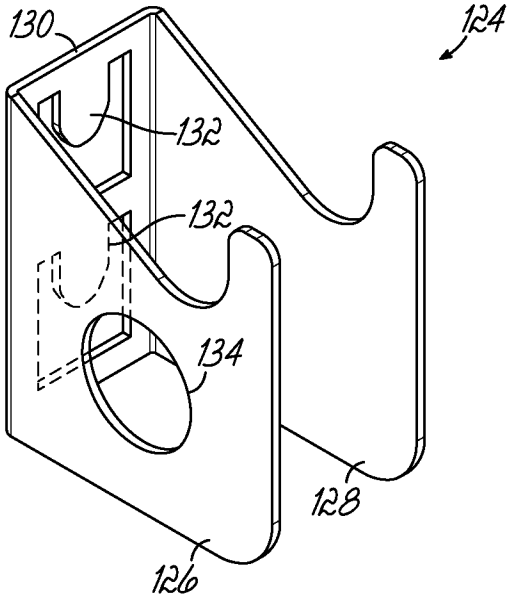
FIG. 12 is a double light hook for use with the retention board of FIG. 1.

FIG. 10 illustrates a double light hook 100 with two extension portions 102, 104 and a mounting portion 106 with two tabs 108. Tabs 108 are sized to fit into two through slots 18 of protrusion 14 to thereby removably secure the hook 100 to the retention board 10. FIG. 11 illustrates a double light hook 110 with two extension portions 112, 114 and a mounting portion 116 with two tabs 118. Tabs 118 are sized to fit into two through slots 18 of protrusion 14 to thereby removably secure the hook 100 to the retention board 10. Extension portion 114 has a hole 120. FIG. 12 illustrates a double light hook 124 with two extension portions 126, 128 and a mounting portion 130 with two tabs 132. Tabs 118 are sized to fit into two through slots 18 of protrusion 14 to thereby removably secure the hook 100 to the retention board 10. Extension portion 126 has a hole 134. FIG. 13 illustrates an organizer 140 with an extension portion 142 with a series of holes 144. A forward panel 146 extends upwardly from the front edge of the extension portion 142. The forward panel 146 includes a displaced member 148 with a bottom surface 150 attached to the forward panel 146 to form a slot 152. The organizer 140 includes a mounting portion 154 with four tabs 156. Tabs 118 are spaced and sized to fit into four through slots 18 of protrusion 14 to thereby removably secure the hook 100 to the retention board 10.

Figure 14:
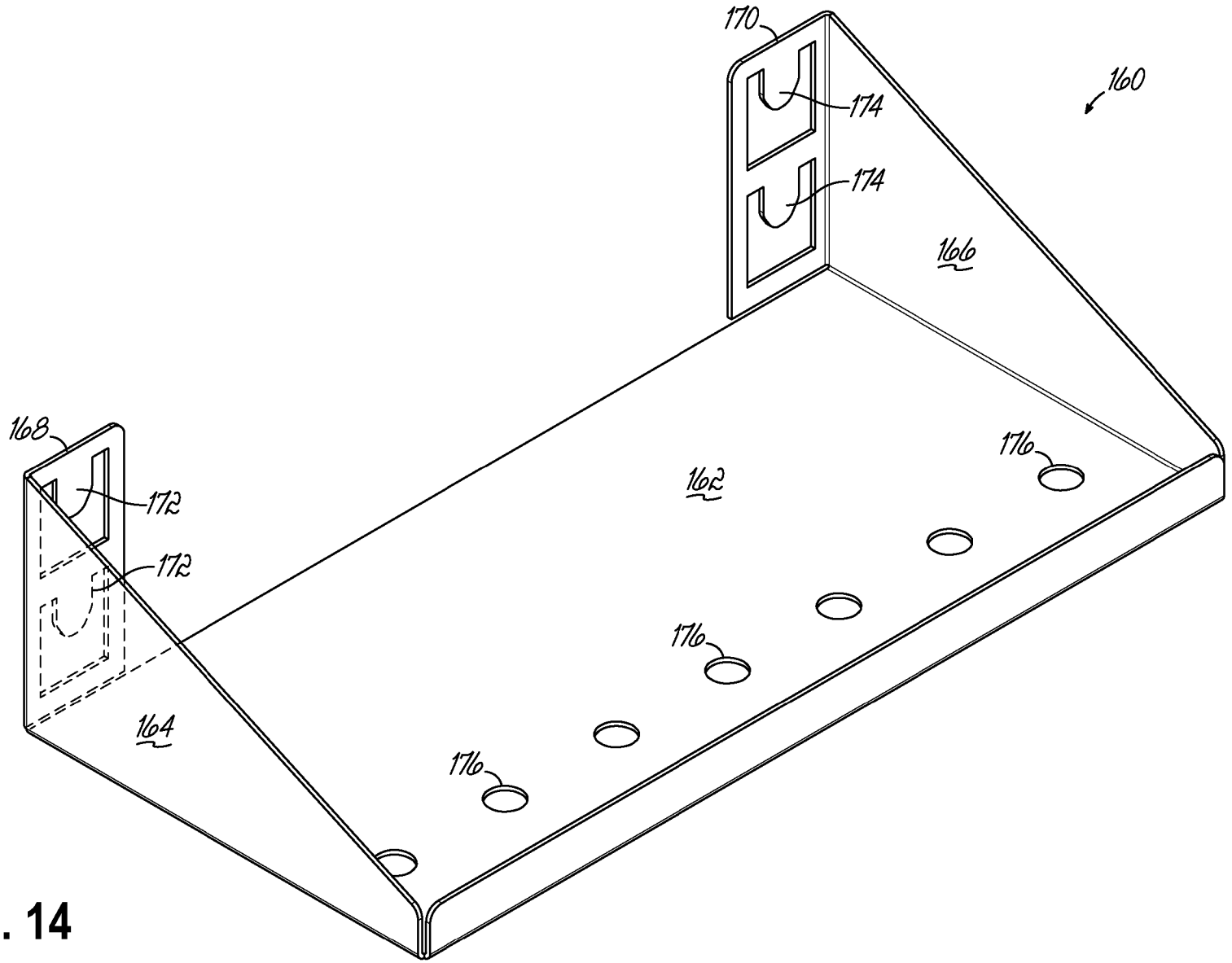
FIG. 14 is a shelf for use with the retention board of FIG. 1.

FIG. 14 illustrates a shelf unit 160, which is similar to shelf unit 60 in FIG. 6. Shelf unit 160 has a support surface 162 connected at either end to angle members 164, 166. Each angle member 164, 166 has a mounting portion 168, 170, respectively. Each mounting portion 168, 170 has two tabs 172, 174, respectively. Each tab 172, 174 is sized and spaced apart such that the shelf unit 160 engages four through slots 18 of protrusions 14 to secure the shelf unit 60 to the retention board 10. The support surface 162 includes a series of holes 176.

What is claimed is:

1. A retention system, comprising:

a planar surface having first and second opposing sides;

an array of spaced through holes in the planar surface defining a plurality of rows of through holes and a plurality of columns of through holes; and an array of spaced protrusions extending from the first side of the planar surface and defining a plurality of rows of protrusions and a plurality of columns of protrusions, wherein each row of protrusions is disposed between two adjacent rows of the through holes, and wherein each protrusion includes a through slot oriented in a column direction of the protrusion.

2. The retention system of claim 1, wherein each column of through holes is parallel to a corresponding column of protrusions.

3. The retention system of claim 2, wherein each column of through holes is collinear with a corresponding column of protrusions.

4. The retention system of claim 1, wherein the through slot of each protrusion has an outer boundary defining a trapezoid.

5. The retention system of claim 1, wherein the planar surface and the protrusions form a monolithic structure.

6. An organizing set comprising:

a planar surface having first and second opposing sides;

an array of spaced through holes in the planar surface defining a plurality of rows of through holes and a plurality of columns of through holes;

an array of spaced protrusions extending from the first side of the planar surface and defining a plurality of rows of protrusions and a plurality of columns of protrusions, wherein each protrusion of the array of protrusions includes a through slot oriented in a column direction of the protrusion; and an attachment accessory having at least one tab, the attachment accessory configured to support an item, wherein the attachment accessory is configured to be selectively coupled to the planar surface by engaging the at least one tab with the through slot of at least one protrusion of the array of protrusions, wherein each row of protrusions is disposed between two adjacent rows of the through holes.

7. The organizing set of claim 6, wherein each column of through holes is parallel to a corresponding column of protrusions.

8. The organizing set of claim 7, wherein each column of through holes is collinear with a corresponding column of protrusions.

9. The organizing set of claim 6, wherein the through slot of each protrusion has an outer boundary defining a trapezoid.

10. The organizing set of claim 6, wherein the planar surface and the protrusions form a monolithic structure.

11. The organizing set of claim 6, wherein the attachment accessory includes a mounting portion, the tab extending from the mounting portion, the attachment accessory further includes at least one extension portion coupled to the mounting portion and extending away from the planar surface when coupled to the planar surface, the extension portion configured to support the item.

12. The organizing set of claim 11, wherein the attachment accessory includes two extension portions coupled to the mounting portion and extending away from the planar surface when coupled to the planar surface.

13. The organizing set of claim 12, wherein the mounting portion includes two vertically aligned tabs, wherein the twos tab are configured to engage two corresponding through slots.

14. The organizing set of claim 13, wherein at least one extension portion includes a hole configured to receive a second item therethrough.

15. The organizing set of claim 6, wherein the attachment accessory includes a support surface with opposing ends and a mounting portion operatively coupled to each end, each mounting portion having at least one tab, the at least one tab on each mounting portion configured to be selectively coupled to the planar surface by engaging the at least one tab on each mounting portion with a through slot of a corresponding protrusion of the array of protrusions.

16. The organizing set of claim 15, wherein each mounting portion includes two vertically aligned tabs, wherein the two tabs are configured to engage two corresponding through slots.

17. The organizing set of claim 15, wherein the at least one tab is positioned below the support surface when the attachment accessory is coupled to the planar surface.

18. The organizing set of claim 15, wherein the at least one tab is positioned above the support surface when the attachment accessory is coupled to the planar surface.

19. The organizing set of claim 6, wherein the attachment accessory includes an extension portion configured to extend away from the planar surface when the attachment accessory is coupled to the planar surface, a mounting portion operatively coupled to the extension portion and configured to extend along the planar surface when the attachment accessory is coupled to the planar surface, the mounting portion having opposing ends and at least one tab on each opposing end, the tabs being offset from the mounting portion such that when the tabs engage through slots in the protrusions the mounting portion clears the protrusions behind the mounting portion.

20. The organizing set of claim 19, wherein the attachment accessory further includes at least two spaced-apart fingers operatively coupled to and extending away from the extension portion, the extension portion further including at least one hole for receiving the item therethrough.

21. The organizing set of claim 6, wherein the attachment accessory further includes an extension portion configured to extend away from the planar surface when the attachment accessory is coupled to the planar surface, a mounting portion coupled to the extension portion, and a forward panel coupled to the extension portion, the mounting portion includes at least two vertically aligned tabs, wherein the at least two tabs are configured to engage two corresponding through slots, the forward panel having a displaced member configured to form a slot between the forward panel and the displaced member.

22. A method for manufacturing a retention system comprising:

providing a planar surface having first and second opposing sides;

forming in the planar surface an array of spaced through holes defining a plurality of rows of through holes and a plurality of columns of through holes; and forming in the planar surface an array of spaced protrusions extending from the first side of the planar surface and defining a plurality of rows of protrusions and a plurality of columns of protrusions, wherein each row of protrusions is disposed between two adjacent rows of the through holes, and wherein each protrusion includes a through slot oriented in a column direction of the protrusion.

23. The method for manufacturing of claim 22, wherein the forming an array of spaced through holes is by drilling or punching.

24. The method for manufacturing of claim 22, wherein each of the forming steps is by stamping.

25. The method for manufacturing of claim 22, wherein the planar surface and the protrusions are a monolithic structure.

26. The method for manufacturing of claim 22, wherein the forming of the through holes and the forming of the protrusions occur simultaneously.

27. The method for manufacturing of claim 22, wherein each column of through holes is parallel to a corresponding column of protrusions.

28. The method for manufacturing of claim 22, wherein the plurality of columns of through holes is collinear with the plurality of columns of protrusions.

* * * * *